United States Patent [19]

Wrightson

[11] 4,178,637

[45] Dec. 18, 1979

[54] FILLED BODY ROBE

[75] Inventor: John C. Wrightson, Darien, Conn.

[73] Assignee: Heritage Quilts Inc., New York, N.Y.

[21] Appl. No.: 828,270

[22] Filed: Aug. 29, 1977

[51] Int. Cl.[2] ..... A41B 9/00

[52] U.S. Cl. ..... 2/69.5

[58] Field of Search ..... 2/69.5, 69; 5/343

[56] References Cited

U.S. PATENT DOCUMENTS

| | | | |
|---|---|---|---|
| 536,383 | 3/1895 | Huyck | 2/69.5 |
| 1,610,799 | 12/1926 | Lack et al. | 2/69 |
| 1,661,768 | 3/1928 | Marshall | 2/69 |
| 1,940,224 | 12/1933 | Munro | 2/69 |
| 2,179,424 | 11/1939 | Phillips et al. | 2/69.5 |
| 2,701,885 | 2/1955 | Turco | 2/69.5 |
| 3,965,487 | 6/1976 | Mazur | 2/69.5 |

*Primary Examiner*—Doris L. Troutman

*Attorney, Agent, or Firm*—Eyre, Mann, Lucas & Just

[57] ABSTRACT

A filled body robe has a closed end, a slide fastener which closes a portion of the front and a plurality of fasteners to shape the upper end into a garment having arm holes and neck hole.

2 Claims, 5 Drawing Figures

FILLED BODY ROBE

DETAILED DESCRIPTION OF THE PREFERRED EMBODIMENT

Figure 1:
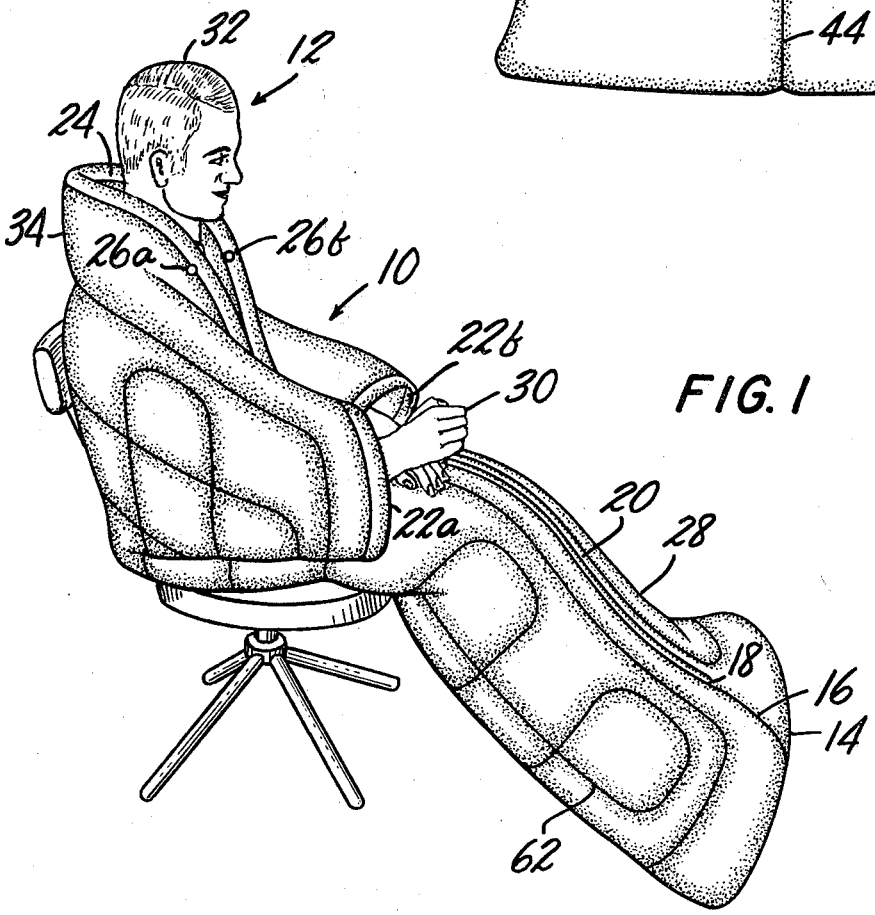
FIG. 1 shows a filled body robe according to the present invention is shaped and worn by a wearer.

Referring now to FIG. 1 there is shown generally at 10 a filled body robe shaped about a wearer 12. The body robe 10 is closed at the bottom end 14 and has a closed seam 16 up the front from the bottom end 14 a short distance to the beginning 18 of a fastener 20. The fastener 20 can be of any convenient type but is preferably a slide fastener of a type well known in the art. At its upper end the filled body robe 10 has two arm holes **22*a*, 22*b* and a neck hole 24 formed in the manner which will be described. A fastener made up of parts 26*a* and 26*b* closes the front of the filled body robe 10 across the chest and around the neck of the user 12. Additional fasteners may be employed as will be described. The filled body robe of the present invention is intended for use by the user 12 during relatively sedentary activities such as lounging and reading. The legs of the user are fully contained within the closed lower portion 28 of the filled body robe 10 while leaving the hands 30 and the head 32 exposed. The top of 34 of the filled body robe can be formed into a cowl which may be draped around the neck of the wearer 12** or can be raised about his head.

Figure 2:
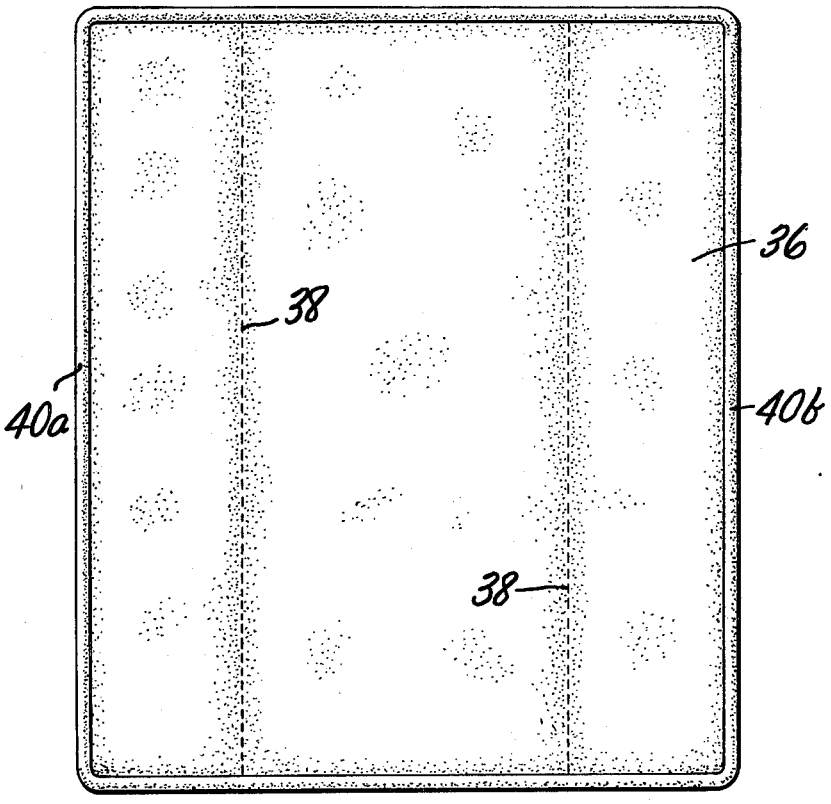
FIG. 2 shows a quilt-like rectangle which is shaped to form the filled body robe of the present invention.

Referring now to FIG. 2 there is shown a cloth rectangle 36, which may be a filled quilt-like material from which the filled body robe 10 is made. The quilt-like rectangle 36 is folded inward from both sides at the quarter width points 38 indicated by the dashed lines, thus making the outer edges **40*a* and 40*b* meet in the center. The lower edge 42 of the folded assembly is sewn completely across to form a seam closing the bottom end 14 of the body robe 10. The junction of the outer edges 40*a* and 40*b* is sewn upward forming a seam for a short distance to the point 46 preferably about one foot from the sewn lower edge 42. This forms the closed bottom end 14 of the body robe 10**.

Figure 3:
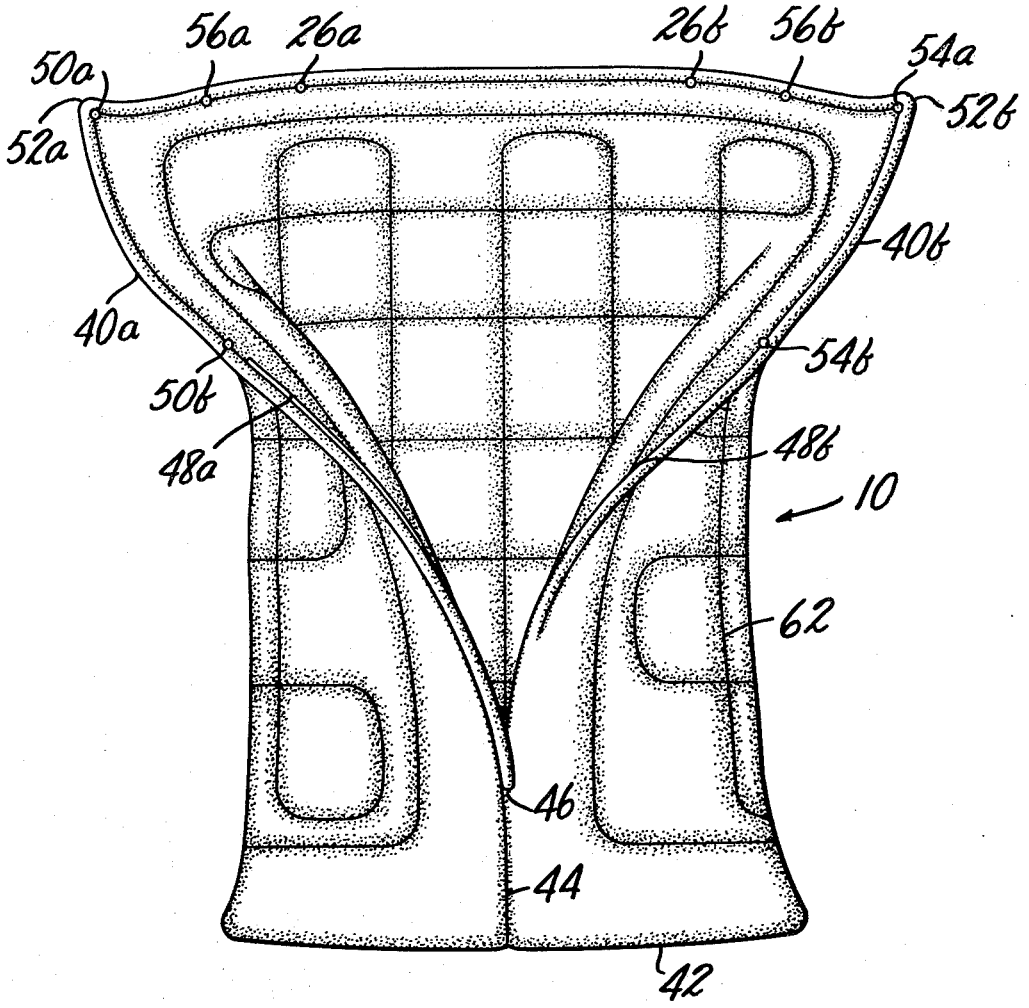
FIG. 3 shows a body robe fully opened out to show the location of seams and fasteners.

Referring now to FIG. 3, the filled body robe 10 of the present invention 10 is shown opened to reveal its details. The front seam 44 begins at the lower edge 42 and continues upward to the point 46 at which a closeable and openable slide fastener **48*a*, 48*b* begins. This slide fastener 48*a*, 48*b* is preferably about thirty inches long. The slide fastener 48*a*, 48*b* together with the seam 44 close the entire lower portion of the body robe 10 about the wearer 12** leaving his head, shoulders and arms exposed.

Figure 4:
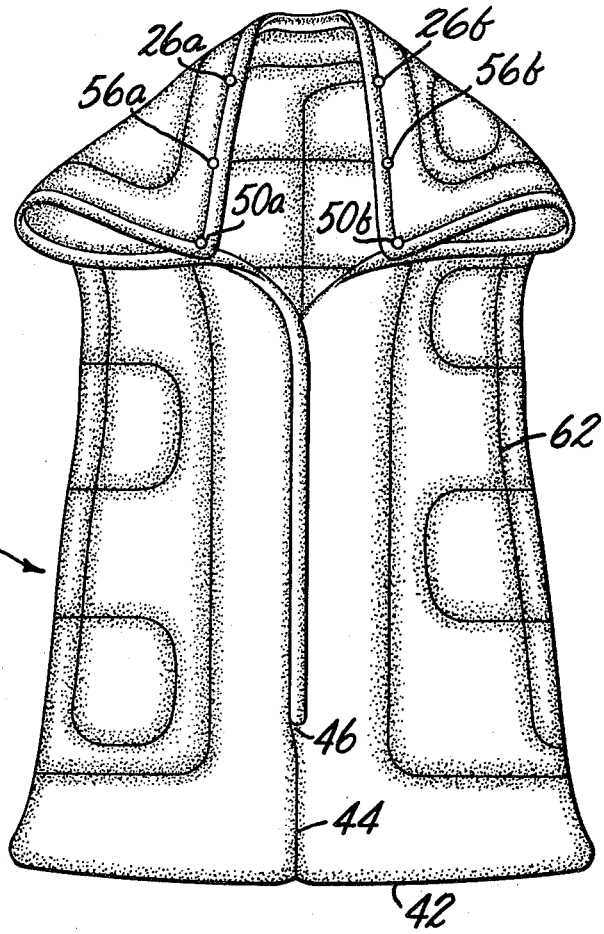
FIG. 4 shows a filled body robe according to the present invention partly closed to illustrate the shaping of the arm holes and the neck hole.

Cooperating parts **50*a* and 50*b* comprise a fastener located respectively in the upper left corner 52*a* of the quilt-like rectangle 36 and on the left edge of the quilt-like rectangle 36 just above the slide fastener 48*a*, 48*b* the fastener parts 50*a* and 50*b* are adapted to be affixed together to form an arm hole 22*b* in the left of the filled body robe 10 (right armhole of the user). Similarly cooperating fasteners 54*a* and 54*b* are located in the upper right corner 52*b* and right edge 40*b* respectively of the quilt-like rectangle 36 to form the other armhole 22*a*. Fasteners 50*b* and 54*b* may be for example male parts of snap fasteners and fasteners 50*a*, 54*a* may be the female parts of snap fasteners of a type well known in the art. Thus, for example, fastener 50*a* can be attached to 50*b* while fastener 54*a* can be attached to 54*b* to form the arm holes. This configuration is shown in FIG. 4. Alternatively fastener 50*a* can be folded across to fasten on fastener 54*b* while fastener 54*a* can be folded across to fasten on fastener 50*b*. This arrangement desirably holds the top of the slide fastener 48*a*, 48*b* together. The cooperating fasteners 26*a*, 26*b* tend to hold the front of the filled body robe closed under the chin of the user. An additional pair of cooperating fasteners 56*a*, 56*b* may optionally be provided to hold the filled body robe 10** closed over the chest of the user.

Figure 5:
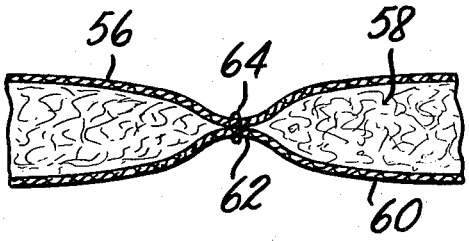
FIG. 5 shows a fragmentary cross-section of the present invention.

A filled body robe according to the present invention can be made out of any convenient material. A cross-sectional view of a preferred embodiment is shown in FIG. 5. An outer cloth shell 56 preferably of 50% polyester and 50% cotton covers a filling 58 of fibrous polyester. A liner 60 preferably of 80% acetate and 20% nylon brushed tricot cloth encloses the filling 58. A quilting seam 62 formed by stitching with thread 64 preferably of 100 percent nylon is used to form the pattern shown in FIGS. 1, 3 and 4 and also to hold the filling 58 in place.

To accommodate people taller than 5'8", a quilt-like rectangle 36 (FIG. 2) 68" wide by 84" long is preferred. This yields a finished filled body robe 10 of 34" wide by 84" long. For people between 4'10" and 5'8" tall the filled body robe 10 is preferably 30" wide by 74" long. For people under 4'10" the preferred dimensions are 30" wide by 62" long.

The bottom 14 may have one or two leg openings (not shown) which the wearer may use to move about while wearing the body robe. The leg openings may be unsewn portions of the seam optionally closable with suitable fasteners.

It will be understood that the claims are intended to cover all changes and modifications of the preferred embodiments of the invention, herein chosen for the purpose of illustration which do not constitute departures from the spirit and scope of the invention.

What is claimed is:

1. A quilted garment adapted to enclose an adult wearer thereof while allowing relatively free movement of the hands external of the garment comprising:

(a) a quilted textile fabric having a back portion and outlying quarter portions, the bottom portion of each outlying quarter portion on each side of which is folded towards the other said outlying quarter portion until they abut;

(b) a first seam joining the bottom of each of the folded outlying quarter portions to the said back portion;

(c) a second seam joining the outer side edge of the bottom portion of one said folder quarter portions to the outer side edge of the bottom portion of the other said folded quarter portion for a distance of approximately one foot;

(d) a slide fastener for joining the outer side edge of one said folded quarter portion to the outer edge of the other said folded quarter portion, said slide fastener extending from substantially the upper end of said second seam to a point approximately thirty inches thereabove;

(e) first fastening means on the outer edge of each said quarter portions positioned at about the end of said slide fastener;

(f) second fastening means at the top of the outer edge of each said quarter portion, each said second fastening means cooperativey attaching to one said first fastening means wherein open unobstructed arm holes are formed for the wearer through which the hands are free to protrude.

2. The quilted garment of claim 1 further including additional fastening means along each said outer side edge and intermediate said first and second fastening means, said additional fastening means along one said outer edge cooperatively attaching to adjacent means along the other said outer side edge.

* * * * *